US012053082B1

(12) United States Patent
Swan et al.

(10) Patent No.: US 12,053,082 B1
(45) Date of Patent: Aug. 6, 2024

(54) TACTICAL ACCESSORY HOLDER

(71) Applicant: S&S Precision, LLC, Virginia Beach, VA (US)

(72) Inventors: Johnny E. Swan, Virginia Beach, VA (US); Andrew C. Borland, Virginia Beach, VA (US); William-Joseph B. Elizalde, Virginia Beach, VA (US)

(73) Assignee: S&S Precision, LLC, Virginia Beach, VA (US)

( * ) Notice: Subject to any disclaimer, the term of this patent is extended or adjusted under 35 U.S.C. 154(b) by 0 days.

(21) Appl. No.: 18/381,713

(22) Filed: Oct. 19, 2023

Related U.S. Application Data

(60) Provisional application No. 63/438,940, filed on Jan. 13, 2023.

(51) Int. Cl.
*A45F 5/00* (2006.01)
*A45F 5/02* (2006.01)

(52) U.S. Cl.
CPC ..... *A45F 5/00* (2013.01); *A45F 5/02* (2013.01); *A45F 2005/027* (2013.01)

(58) Field of Classification Search
CPC ..... A45F 5/00; A45F 5/02; A45F 2200/0516; A45F 2005/027
USPC ..... 227/270, 930
See application file for complete search history.

(56) References Cited

U.S. PATENT DOCUMENTS 3,541,976 A * 11/1970 Rozas ..... A47B 23/002 224/616
5,395,023 A * 3/1995 Naymark ..... A45F 5/02 224/199
7,110,802 B1 * 9/2006 Kim ..... H04B 1/3888 455/90.3
7,665,641 B2 * 2/2010 Kaufman ..... G06F 1/163 224/261
7,712,645 B2 * 5/2010 Calkin ..... A61F 17/00 224/191
8,070,026 B2 * 12/2011 Wadsworth ..... F16M 13/04 224/269
8,505,790 B2 * 8/2013 Yu ..... F16M 11/28 224/625
9,219,516 B2 * 12/2015 Haymond ..... B65D 25/00
9,510,662 B1 * 12/2016 Bruns ..... A45F 5/021
9,737,132 B2 * 8/2017 Bruns ..... A45F 5/02
9,856,895 B2 * 1/2018 Kieley ..... F16M 13/022
10,485,326 B2 * 11/2019 Williamson ..... A41D 1/002
D879,763 S * 3/2020 Park ..... D3/249
10,660,426 B2 * 5/2020 Norman ..... A47B 23/002
(Continued)

*Primary Examiner* — Justin M Larson
(74) *Attorney, Agent, or Firm* — Tanner IP, PLLC

(57) ABSTRACT

Accessory holders are described having a mounting portion that attaches the accessory holder to wearable support structure, and a carrier frame that holds a first personal accessory. A rotating arm connects the carrier frame to the mounting portion. The carrier frame includes a retaining mechanism, such as an elastomeric strap, nylon webbing, hook and loop fasteners, etc., for holding the first personal accessory to the carrier frame. The arm includes a hinge configured to allow the carrier frame to move between a folded position and an unfolded position with respect to the mounting portion and the mounting portion includes attachment means, such as attachment or mounting straps, spear fittings, hook and loop fasteners, etc., for securing the accessory holder to the wearable support structure.

20 Claims, 17 Drawing Sheets

(56) References Cited

U.S. PATENT DOCUMENTS

| | | | | |
|---|---|---|---|---|
| 10,999,958 | B2 * | 5/2021 | Frazier | A45F 5/021 |
| 11,013,308 | B2 * | 5/2021 | Jones | A45F 3/14 |
| 11,019,914 | B2 * | 6/2021 | Swan | F41C 33/041 |
| 11,832,712 | B2 * | 12/2023 | Carnevali | A45F 5/00 |
| 2001/0035444 | A1 * | 11/2001 | Alis | H04B 1/3888 D3/218 |
| 2007/0164987 | A1 * | 7/2007 | Graham | B60R 11/0241 345/7 |
| 2008/0040960 | A1 * | 2/2008 | Keith | G06F 1/163 40/586 |
| 2008/0149678 | A1 * | 6/2008 | Huang | A45F 5/021 224/199 |
| 2013/0048514 | A1 * | 2/2013 | Corcoran | A45C 11/00 206/472 |
| 2013/0213838 | A1 * | 8/2013 | Tsai | G06F 1/1633 206/320 |
| 2013/0258573 | A1 * | 10/2013 | Muday | G06F 1/1613 361/679.01 |
| 2015/0237997 | A1 * | 8/2015 | Bruns | A45F 5/021 224/191 |
| 2015/0288406 | A1 * | 10/2015 | Haymond | H04B 1/3888 455/575.8 |
| 2017/0068270 | A1 * | 3/2017 | Kielland | G06F 1/1647 |
| 2022/0302947 | A1 * | 9/2022 | Hettinger | F16M 11/10 |

* cited by examiner

TACTICAL ACCESSORY HOLDER

BACKGROUND OF THE INVENTION

The use of small personal electronic devices, such as smart phones, personal GPS devices, etc., has become widespread in military and law enforcement units, and throughout the first responder, emergency response, and civilian markets. Military units, law enforcement agencies, civil services, and civilians now use such devices for myriad purposes limited only by the range of hardware capabilities and software applications that are built in to, or adapted by, such devices. Some of the more significant uses of personal electronic devices in the tactical and emergency response arenas include navigation, communication, and various monitoring capabilities. However, a significant challenge in the tactical use of such devices is the variety of forms that they take, and the development of carriers that can both accommodate a variety of devices and do so in a readily accessible, yet unobtrusive, manner.

BRIEF SUMMARY OF THE INVENTION

According to aspects of the disclosure, embodiments may generally include accessory holders having one or more of a mounting portion configured to attach the accessory holder to wearable support structure, a carrier frame configured to hold a first personal accessory, and an arm connecting the carrier frame to the mounting portion. In embodiments, the carrier frame may include a retaining means, such as an elastomeric strap, nylon webbing, hook and loop fasteners, etc., for holding the first personal accessory to the carrier frame. In embodiments, the arm may include a first hinge configured to allow the carrier frame to move between a folded position and an unfolded position with respect to the mounting portion. In embodiments, the mounting portion may include attachment means, such as one or more attachment or mounting straps, spear fittings, hook and loop fasteners, etc., for securing the accessory holder to the wearable support structure.

In embodiments, the mounting portion and/or the carrier frame may include a rigid base element formed of material such as plastic, carbon fiber, metal, etc. The rigid base element may be relatively flat or plate-shaped, and may include one or more voids or wells configured to attach the base element to support structure and/or other components, or vice versa.

In embodiments, the attachment means may include a mounting strap, and the mounting strap may include an enlarged tab at a distal end thereof. A rigid base element of the mounting portion may include a well that is sized and shaped to accommodate and hold the mounting strap tab. In embodiments, a fixed end of the mounting strap may be secured to the rigid base element of the mounting portion and the distal end of the mounting strap may be configured to wind through portions of support structure, such as MOLLE attachment points, etc., and secure back to the attachment well via the mounting strap tab.

In embodiments, the mounting portion may include a retaining tab, and the carrier frame may include a retaining tab well that is sized and shaped to accommodate and hold the retaining tab, e.g. with the carrier frame in the folded position such that the carrier frame may be prevented from unfolding from the mounting portion.

In embodiments, the mounting portion may include a rigid base and the retaining tab may be attached to the rigid base via a length of elastic material. In such instances, a user can, for example, release the retaining tab from the retaining tab well by pulling the retaining tab and thereby stretching the length of elastic material.

In embodiments, the mounting portion may include an adjustment mechanism and/or track configured to allow movement of the arm with respect to the mounting portion. For example, the adjustment mechanism may be configured to allow the connector or hinge for the arm and the mounting portion to be moved "up" and "down" with respect to the mounting portion.

In embodiments, the arm may be configured so that a length of the arm can be manually adjusted by a user. This may allow, for example, a relative position of the carrier frame with respect to the mounting portion to be changed. In embodiments, the arm may include an extending element that effectively increases a length of the arm, e.g. by telescoping out.

In embodiments, the arm may include a pivot configured to allow manual rotation of the carrier frame with respect to the arm. The pivot may include one or more of a cylindrical hub, a ball socket, or such other mechanisms that allow rotation in one or more directions.

In embodiments, accessory retaining means of the carrier frame may include a length of elastomeric material configured to hold the first personal accessory to the carrier frame. In embodiments, the length of elastomeric material may span one or more corners of the carrier frame, such that personal accessories having different lengths, widths and/or thicknesses may be secured to the carrier frame.

In embodiments, the length of elastomeric material may include a thin portion and a thick portion, with the thick portion having a thickness that is greater than that of the thin portion. The thick portion may be configured to provide a raised friction surface that helps secure the first personal accessory in the carrier frame, and/or to provide a plug that secures the length of elastomeric material to a plug well that is formed in the carrier frame.

In embodiments, the carrier frame may be configured to hold a smart phone having a screen, and the accessory holder may be configured to allow viewing of the screen in the unfolded position, and to protect the screen from direct contact in the folded position.

In embodiments, the carrier frame may include a peripheral attachment void, and the accessory holder may include a peripheral attachment that may be mounted to the peripheral attachment void. The peripheral attachment may be configured, for example, to hold a second personal accessory.

In embodiments, the peripheral attachment may include a peripheral base having a peripheral attachment mechanism configured to join with the peripheral attachment void, a peripheral arm configured to hold the second personal accessory, and/or a second hinge connecting the peripheral base and the peripheral arm.

In embodiments, the carrier frame may include a plurality of peripheral attachment voids, and the accessory holder may include a separate peripheral attachment mounted to each of the peripheral attachment voids. Each of the peripheral attachments may be configured to hold a separate second personal accessory.

In embodiments, the second personal accessory may be at least one of a compass, a GPS, or a camera.

In embodiments, the wearable support structure may be at least one of a plate carrier, a tactical vest, a backpack, a parachute harness, or a personal harness.

In embodiments, the attachment means may include MOLLE compliant straps or other webbing, MOLLE clips, hook and loop fasteners, etc.

According to further aspects of the disclosure, an accessory holder may include one or more of a mounting portion configured to attach the accessory holder to wearable support structure. The mounting portion may include attachment straps for securing the accessory holder to the wearable support structure. A carrier frame may be included that is configured to hold a personal accessory. The carrier frame may include an accessory retaining strap or band made of an elastomeric material. The retaining strap or band may be configured to hold the personal accessory to the carrier frame. An arm may be included that connects the carrier frame to the mounting portion. The arm may include a hinge configured to allow the carrier frame to move between a folded position and an unfolded position with respect to the mounting portion.

In embodiments, the carrier frame may be configured to hold a smart phone having a screen, and the elastomeric material spans corners of the carrier frame, such that smart phones having different lengths, widths or thicknesses may be secured within a perimeter of the carrier frame. In embodiments, the elastomeric material may also be configured to allow smart phones having different lengths, widths or thicknesses to be secured such that one or more edges of the smart phone extend beyond the perimeter of the carrier frame.

According to further aspects of the disclosure, an accessory holder may include one or more of a mounting portion configured to attached the accessory holder to wearable support structure, a carrier frame configured to hold a personal accessory, and/or an arm connecting the carrier frame to the mounting portion. The mounting portion may include a mounting strap for securing the accessory holder to the wearable support structure, and the carrier frame may include a retaining means for holding the personal accessory. The mounting strap may include an attachment tab at a distal end of the mounting strap, and the mounting portion may include an attachment well that is sized and shaped to accommodate and hold the attachment tab.

In embodiments, the arm may include a hinge configured to allow the carrier frame to move between a folded position and a plurality of preconfigured unfolded positions with respect to the mounting portion.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention claimed. The detailed description and the specific examples, however, indicate only preferred embodiments of the invention. Various changes and modifications within the spirit and scope of the invention will become apparent to those skilled in the art from this detailed description.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the related technology. No attempt is made to show structural details of technology in more detail than may be necessary for a fundamental understanding of the invention and various ways in which it may be practiced. In the drawings.

DETAILED DESCRIPTION OF THE INVENTION

Figure 1:
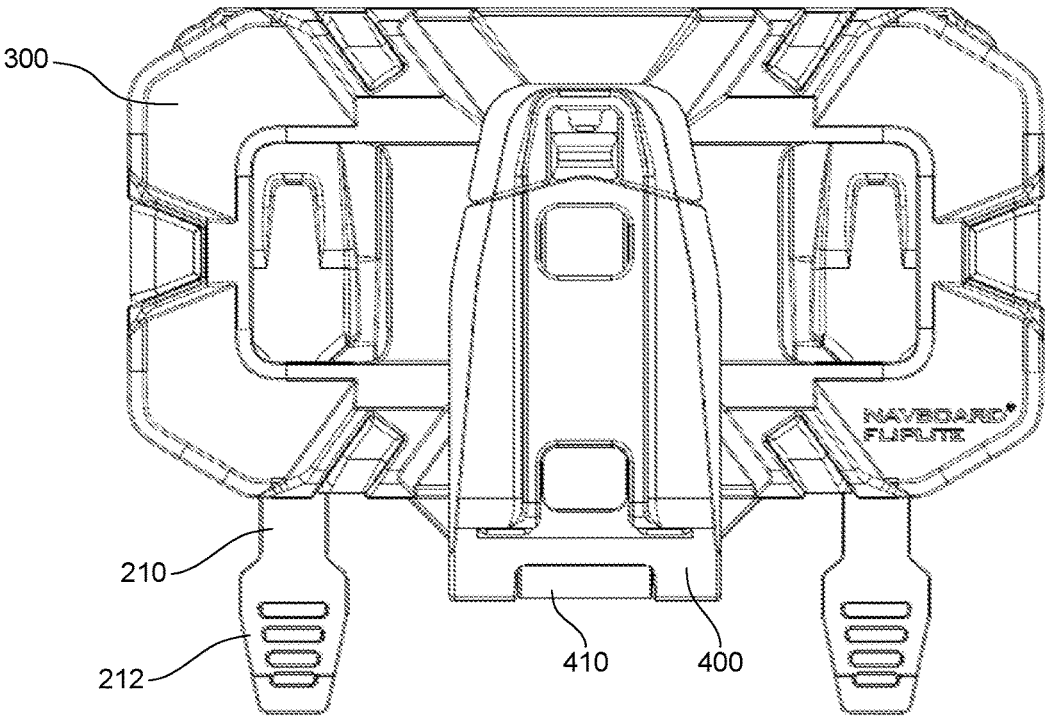
FIG. 1 is a front view of a first embodiment of an exemplary accessory holder according to aspects of the invention.

It is understood that the invention is not limited to the particular methodology, protocols, etc., described herein, as these may vary as the skilled artisan will recognize. It is also to be understood that the terminology used herein is used for the purpose of describing particular embodiments only, and is not intended to limit the scope of the invention. It also is to be noted that as used herein and in the appended claims, the singular forms "a," "an," and "the" include the plural reference unless the context clearly dictates otherwise. Thus, for example, a reference to "a well" is a reference to one or more wells and equivalents thereof known to those skilled in the art.

Unless defined otherwise, all technical terms used herein have the same meanings as commonly understood by one of ordinary skill in the art to which the invention pertains. The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law.

Moreover, provided immediately below is a "Definition" section, where certain terms related to the invention are defined specifically. Particular components, devices, and materials are described, although any components and materials similar or equivalent to those described herein can be used in the practice or testing of the invention. All references referred to herein are incorporated by reference herein in their entirety.

The term "plate shaped" as used herein refers to components that have relatively thin dimensions, e.g. having a thickness less than 10% of the length and/or width of the component. Such shapes may be substantially (i.e. greater than 90%) flat, or may include minor curvatures such as those found in shaped personal armor plates that are configured to conform to a human torso.

The following preferred embodiments may be described in the context of exemplary tactical accessory holders for ease of description and understanding. However, the invention is not limited to the specifically described devices and methods, and may be adapted to various apparatus, such as other personal accessory holders, support structures, etc., without departing from the overall scope of the invention.

Figure 2:
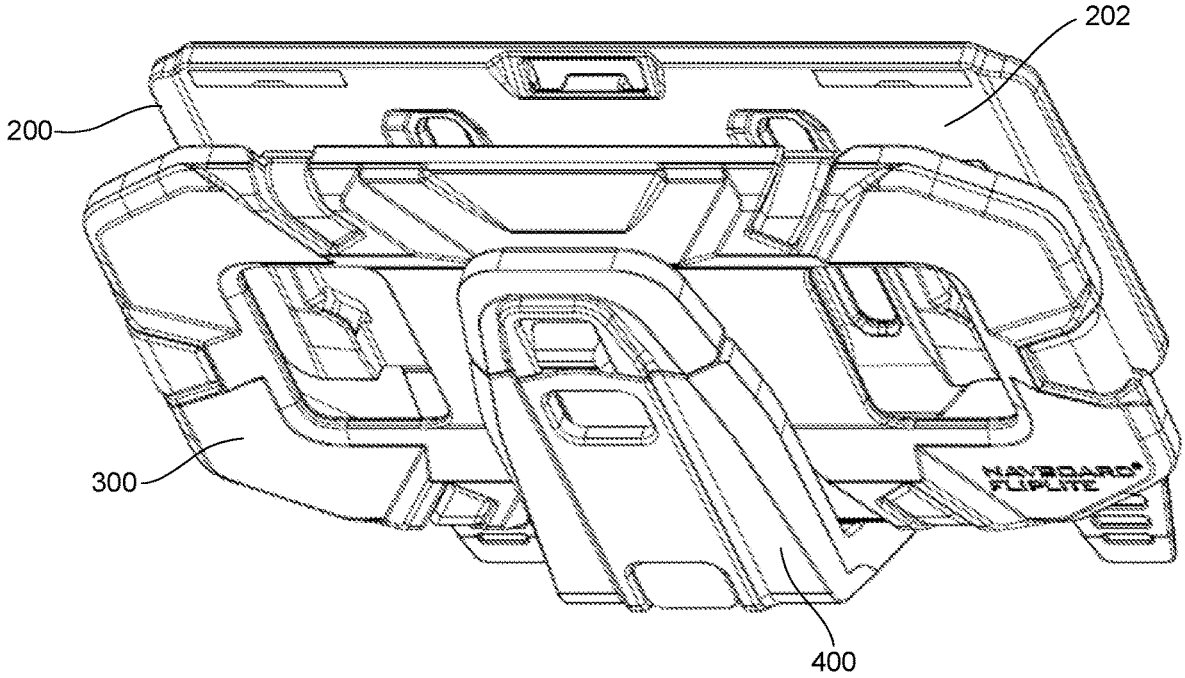
FIG. 2 is a front perspective view of the exemplary accessory holder shown in FIG. 1.

FIG. 1 is a front view of a first embodiment of an exemplary accessory holder 100. FIG. 2 is a front perspective view of accessory holder 100 shown in FIG. 1. As shown in FIGS. 1 and 2, accessory holder 100 may include a mounting portion 200 configured to attach the accessory holder 100 to wearable support structure (see, e.g. FIG. 20). In this case, the mounting portion includes a generally plate shaped rigid base 202 with elastic mounting straps 210 that secure the base to the wearable support structure, as described further below. However, in other embodiments, the means for securing the holder to wearable support structure may include various MOLLE compliant straps or other webbing, MOLLE clips, hook and loop fasteners, etc.

A carrier frame 300 is attached to mounting portion 200 via an arm 400. The carrier frame 300 is substantially formed of a rigid material, such as a plastic, and is configured to hold a personal accessory, such as a smart phone (not shown).

In embodiments, the mounting portion and/or the carrier frame may include a rigid base element formed of material such as plastic, carbon fiber, metal, etc. The rigid base element may be relatively flat or plate-shaped, and may include one or more voids or wells configured to attach the base element to support structure and/or other components, or vice versa, as discussed further below.

In embodiments, the base of the mounting portion and/or the carrier frame may be made of a material that is elastic when bent, but substantially inelastic in tension and/or compression, such as plastic, etc. As used in this context, "substantially" may be understood as including those materials that exhibit such characteristics under normal operational loads. That is, the material is inelastic in tension and/or compression under normal operational loads, which will be appreciated by those of skill in the art, considering the particular type of equipment.

In embodiments, the base(s) may be made of HDPE, PVC, PVC/acrylic alloy, and CPVC, thermoformed sheet material, extruded polymer sheets, and/or hybrid or laminated combinations thereof.

Figure 3:
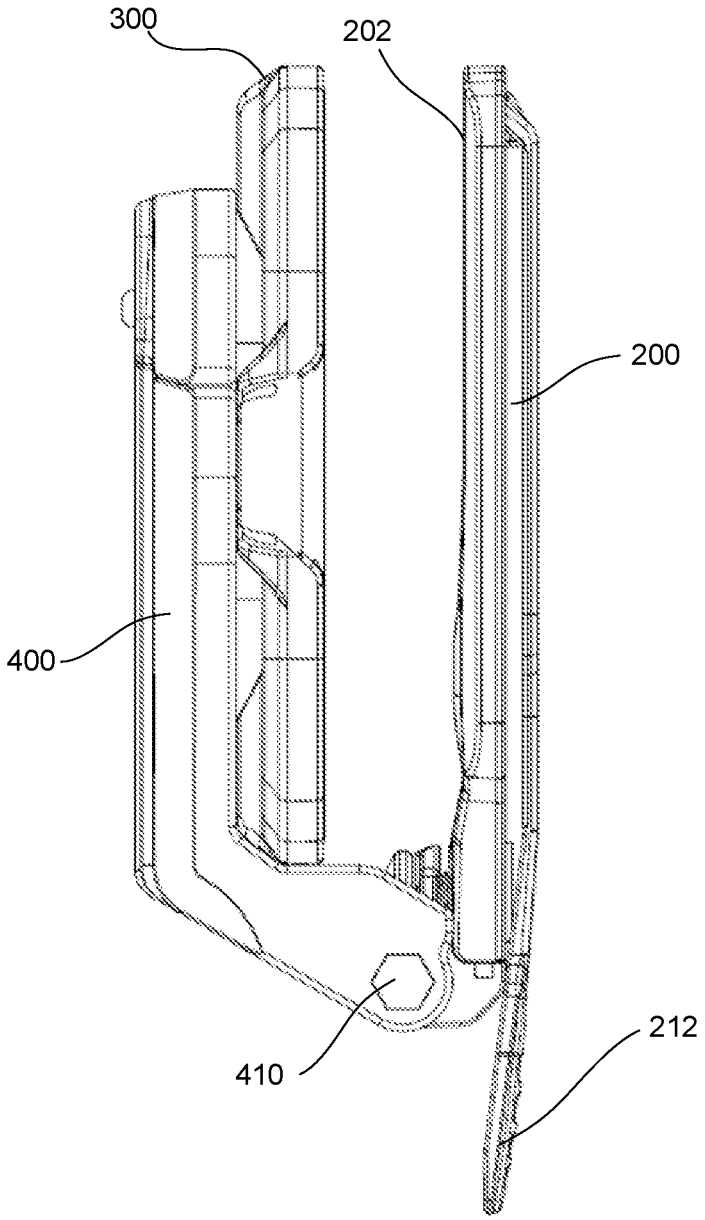
FIG. 3 is a side view of the exemplary accessory holder shown in FIG. 1.

The arm 400 connects the carrier frame 300 to the mounting portion 200. FIG. 3 is a side view of the exemplary accessory holder shown in FIG. 1. As shown in FIG. 3, the arm 400 includes a hinge 410 configured to allow the carrier frame 300 to move between a folded position and an unfolded position with respect to the mounting portion 200. In this case, the hinge is formed to adjust between a plurality of semi-fixed positions. That is, the hinge itself is configured to provide increased resistance in certain preconfigured positions. The hinge 410 is formed of a first part with a cross section that has a plurality of interior angles. In this case a hexagonal cross section. Other cross sections having a plurality of obtuse, or acute, interior angles are also possible, e.g. octagonal, triangular, etc. Cross sections with a plurality of obtuse angles may be preferable in allowing easier transition between different position, with less wear and/or potential damage to the hinge.

In embodiments, the hinge 410 may include a flexible portion, made of rubber or other flexible material, and a rigid portion, made of plastic or other rigid material. The flexible portion may be the first part, and may be surrounded by the rigid portion, or vice versa, such that the flexible portion and/or the rigid portion rotate between the preconfigured positions.

In embodiments, the mounting portion 200 may include attachment means, such as one or more straps, spear fittings, hook and loop fasteners, etc., for securing the accessory holder to the wearable support structure. In the embodiments shown in FIGS. 1-4, the mounting portion 200 includes a pair of mounting straps 210, which may be made of, for example, a rubber or other flexible, elastomeric and/or elastic material. The mounting straps 210 include mounting strap tabs 212 at distal ends of the straps, and are secured to the mounting portion 200 at the other ends of the straps. The mounting portion 200 includes a pair of mounting tab wells 214 that are sized and shaped to accommodate and hold the mounting strap tabs 212. The mounting straps 210 are configured to wind through portions of support structure, such as MOLLE attachment points, etc., and secure back to the mounting tab wells 214 via the mounting strap tabs 212. An example of this can be seen, for example, in FIGS. 5 and 6, in which the mounting strap tabs 212 are shown secured in the mounting tab wells 214. In this instance, the mounting tab wells 214 are formed in the "front" (i.e. facing away from the wearable support structure) of the base of the mounting portion 200. This configuration offers a particular advantage of allowing the user to remove the accessory holder 100 from wearable support structure without doffing the wearable support structure. For example, a user can simply unfold the accessory holder, remove the mounting strap tabs 212 from the mounting tab wells 214 and pull the mounting straps 210 up and out of the wearable support structure.

In embodiments, at least part of the mounting straps 210 may be made of an elastic material, such that, when the mounting strap tabs 212 are secured in the mounting tab wells 214, the mounting straps 210 are under tension and secure the mounting strap tabs 212 in the mounting tab wells 214 while also allowing a user to easily remove the mounting strap tabs 212 from the mounting tab wells 214, e.g. by pulling up and out on the mounting strap tabs 212.

Figure 4:
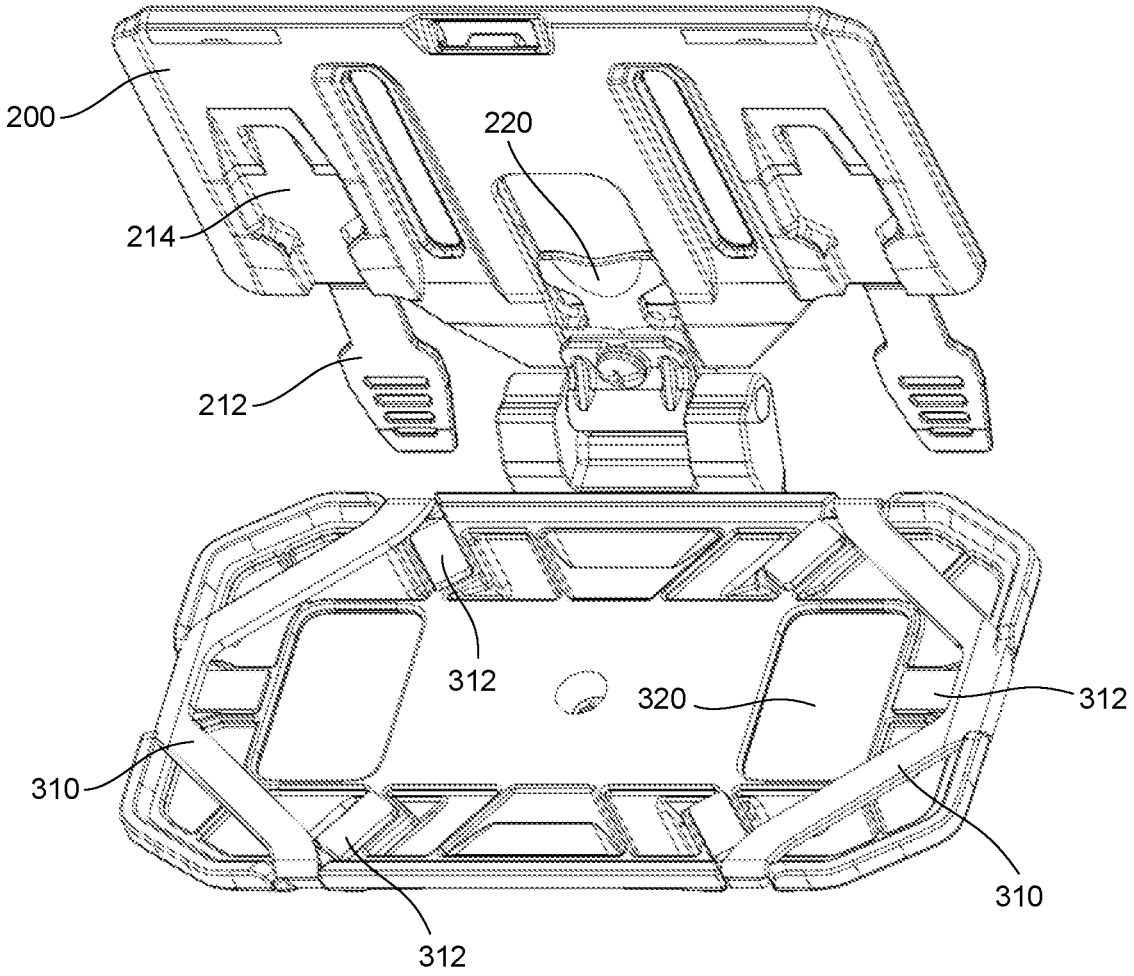
FIG. 4 is a front perspective view of the exemplary accessory holder shown in FIG. 1, in an unfolded configuration.
Figure 5:
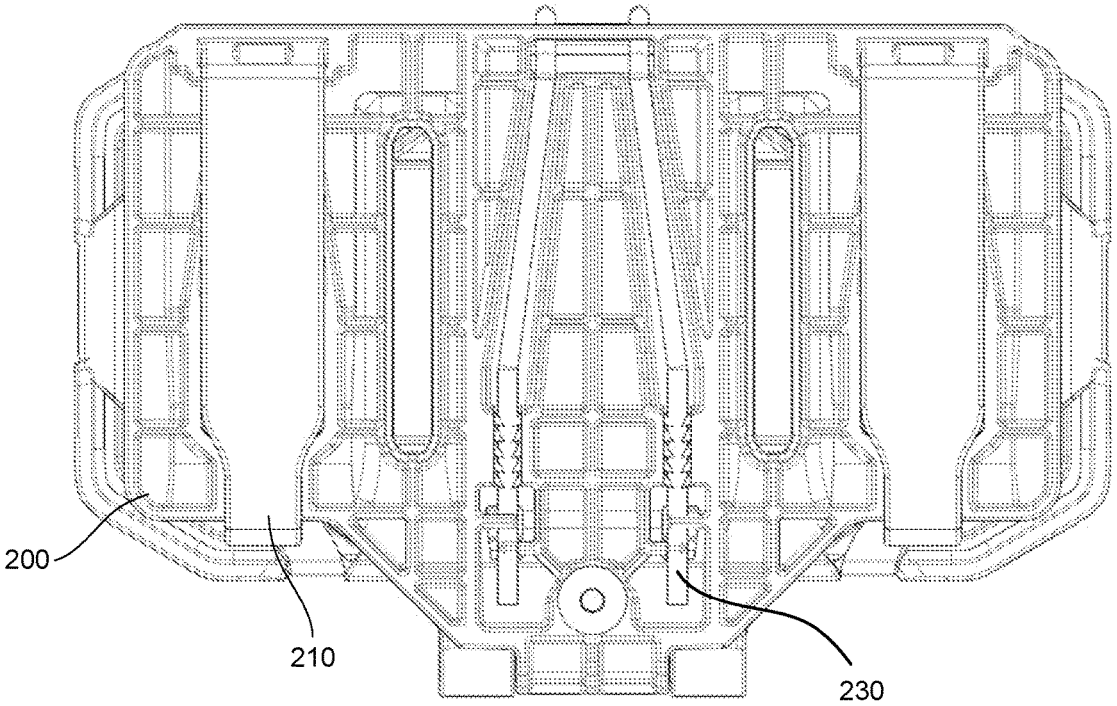
FIG. 5 is a rear view of the exemplary accessory holder according to aspects of the invention.
Figure 6:
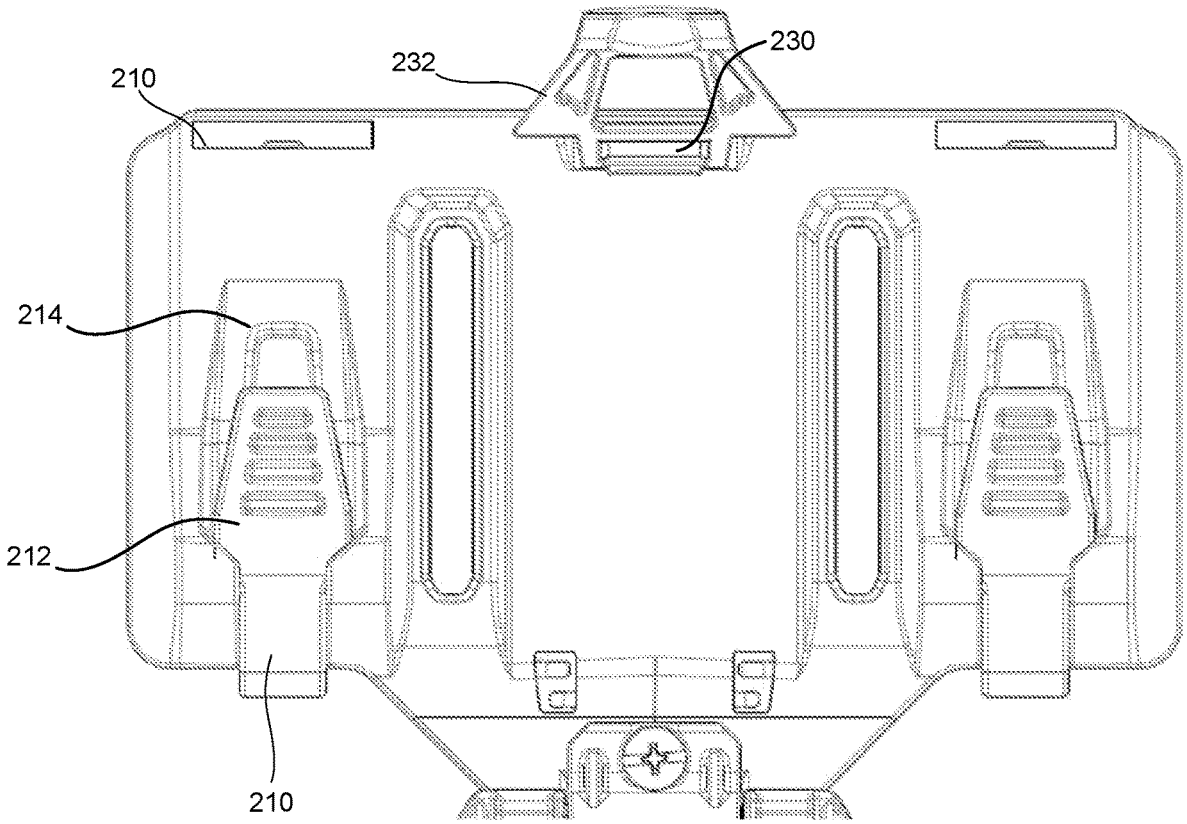
FIG. 6 is a front view of another embodiment of an exemplary mounting portion according to aspects of the invention.
Figure 7:
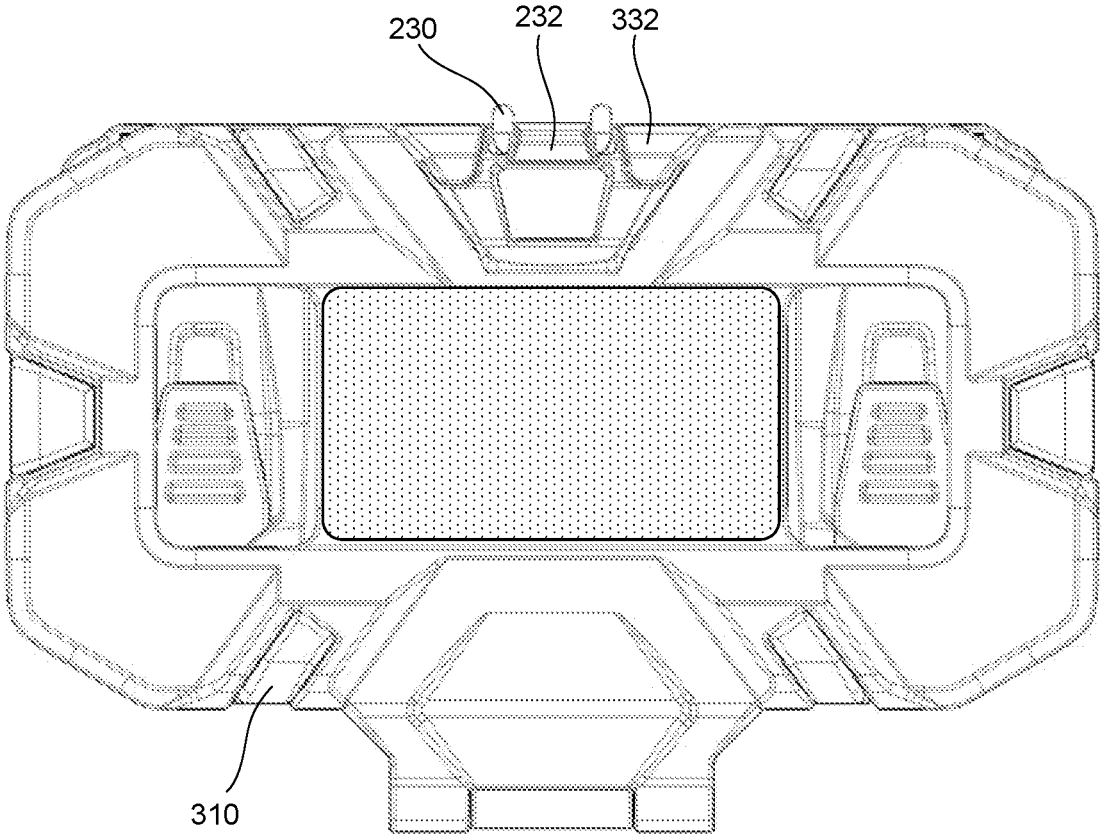
FIG. 7 is a front view of the exemplary accessory holder shown in FIG. 5.

As also shown in FIGS. 5-7, the mounting portion 200 may include a retaining tab 232, and the carrier frame 200 may include a retaining tab well 332 that is sized and shaped to accommodate and hold the retaining tab 232. The retaining tab 232 may be attached to the mounting portion 200 via an elastic cord 230 that allows the retaining tab 232 to be secured in the retaining tab well 332 with the retaining tab 232 under tension to secure it in the retaining tab well 332 while also allowing a user to easily remove the retaining tab 232 from the retaining tab well 332, e.g. by pulling down and out on the retaining tab 232. Thus, the carrier frame 300 may be secure in a "folded" position in which the carrier frame and the mount 200 are substantially parallel, e.g. as shown in FIGS. 2 and 3. In the folded position the carrier frame 300 may be prevented from unfolding from the mount 200 by the retaining tab 232, and, when holding an accessory with a screen, such as smart phone or PDA, may protect the screen from direct contact. As discussed previously, the accessory holder 100 may be configured to allow the carrier frame 300 to fold out and away from mounting portion 200 either in a smooth and consistent manner, or between a plurality of predetermined positions. For example, if using a normal friction hinge, the accessory holder 100 may be unfolded to an infinite number of viewing positions, e.g. between 0 and 180 degrees. Or, with a hinge configured to adjust between a plurality of predetermined positions, such as with flexible hexagonal hinge or other biased or locking hinge, the accessory holder 100 may be unfolded to a set number of viewing positions in which the carrier frame is more securely fixed compared to other viewing angles, e.g. at 90 degrees for a single stop hinge; at 60, 120, and 180 degrees for a hexagonal hinge; or at 45, 90, 135, and/or 180 degrees for an octagonal hinge. The ability to unfold the carrier frame 300 away from mounting portion 200 allows, for example, a user to view and/or access a screen and/or buttons of the accessory held by the holder 100 in the unfolded position. FIG. 4 is a front perspective view of the accessory holder shown in FIG. 1 in an exemplary unfolded configuration.

As also shown in FIG. 4, the carrier frame 300 includes an elastomeric strap 310 for holding the personal accessory to the carrier frame 300. However, it should be appreciated that, unless otherwise specified, other accessory retaining means, such as, nylon webbing, hook and loop fasteners, etc., may be used to hold the personal accessory to the carrier frame 300.

As shown in FIG. 4, two elastomeric straps 310 span all four corners of the carrier frame 300, such that personal accessories having different lengths, widths and/or thicknesses may be secured to the carrier frame 300. That is, because the elastomeric strap 310 spans the corners, accessories having lengths and/or widths that are less than or more than the length and width of the carrier frame 300 may be held by the elastomeric strap 310. Also, because the elastomeric strap 310 is able to stretch, accessories having various thicknesses may also be held by the elastomeric strap 310. To assist with this, the elastomeric strap 310 may include raised friction pads 312 that are proud of (i.e. elevated above the surface of) the carrier frame 300. The friction pads 312 may be formed as relatively thick parts of the elastomeric strap 310 that also plug into or through the carrier frame 300 to secure the elastomeric strap 310 to the carrier frame, as also shown in FIG. 7, which depicts a front view of an accessory holder in a folded configuration, with the elastomeric straps 310 forming a total of six plugs that are secured in voids formed in the rigid base of the carrier frame.

Figure 8A:
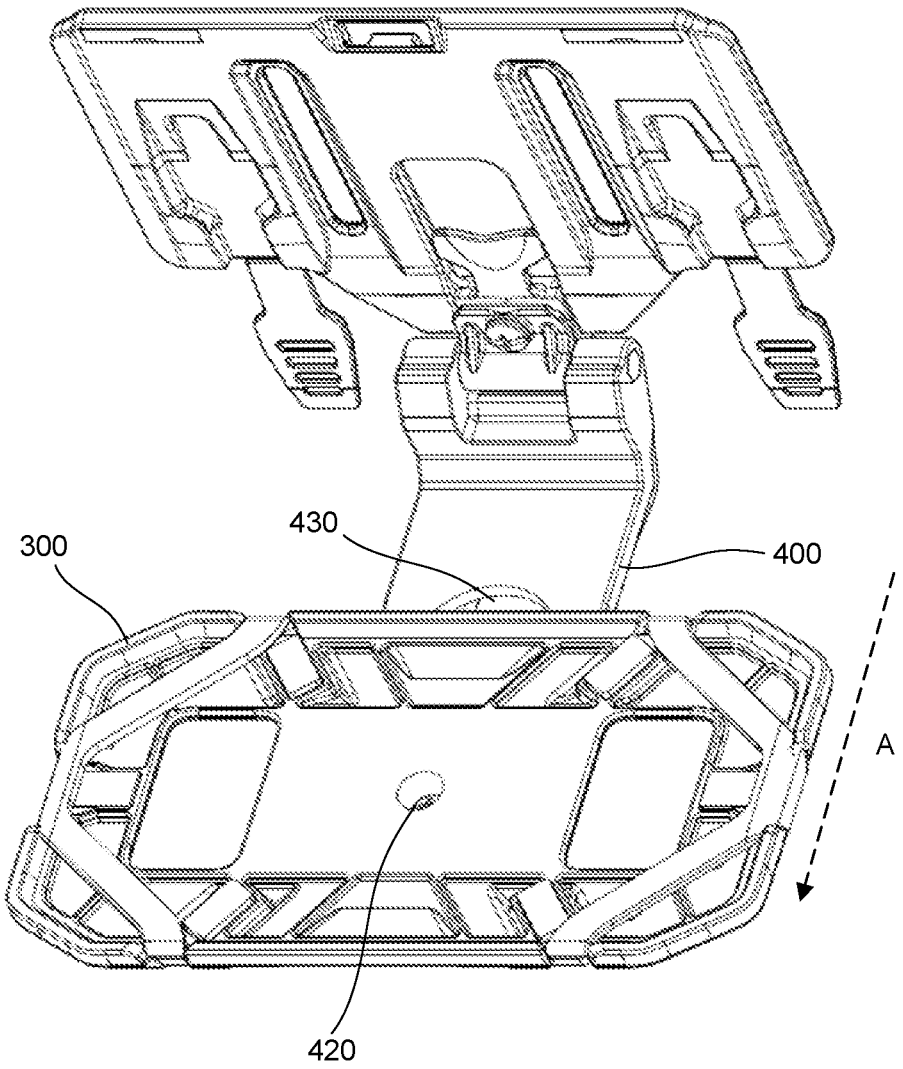
FIGS. 8A-8C variously depict another embodiment of an exemplary accessory holder according to aspects of the invention including an extending arm.
Figure 8B:
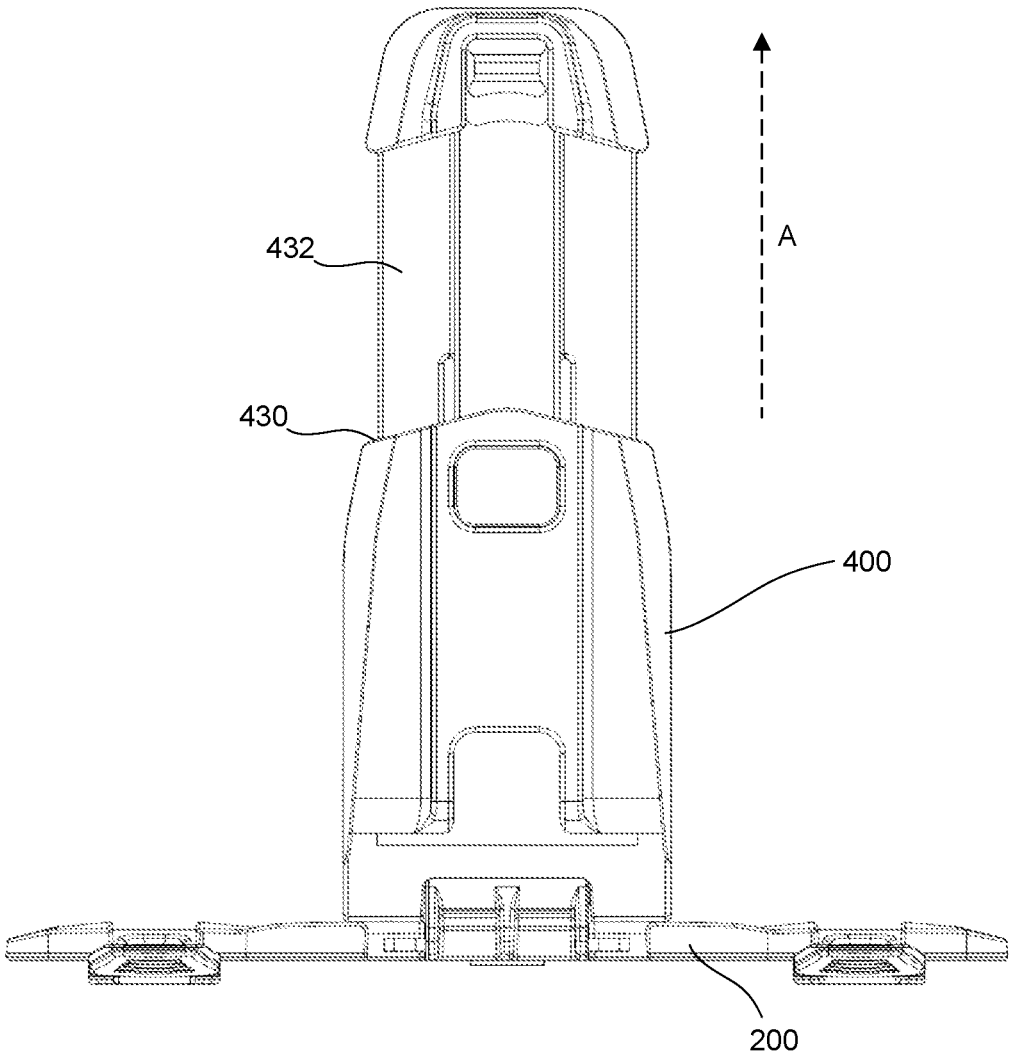
Figure 8C:
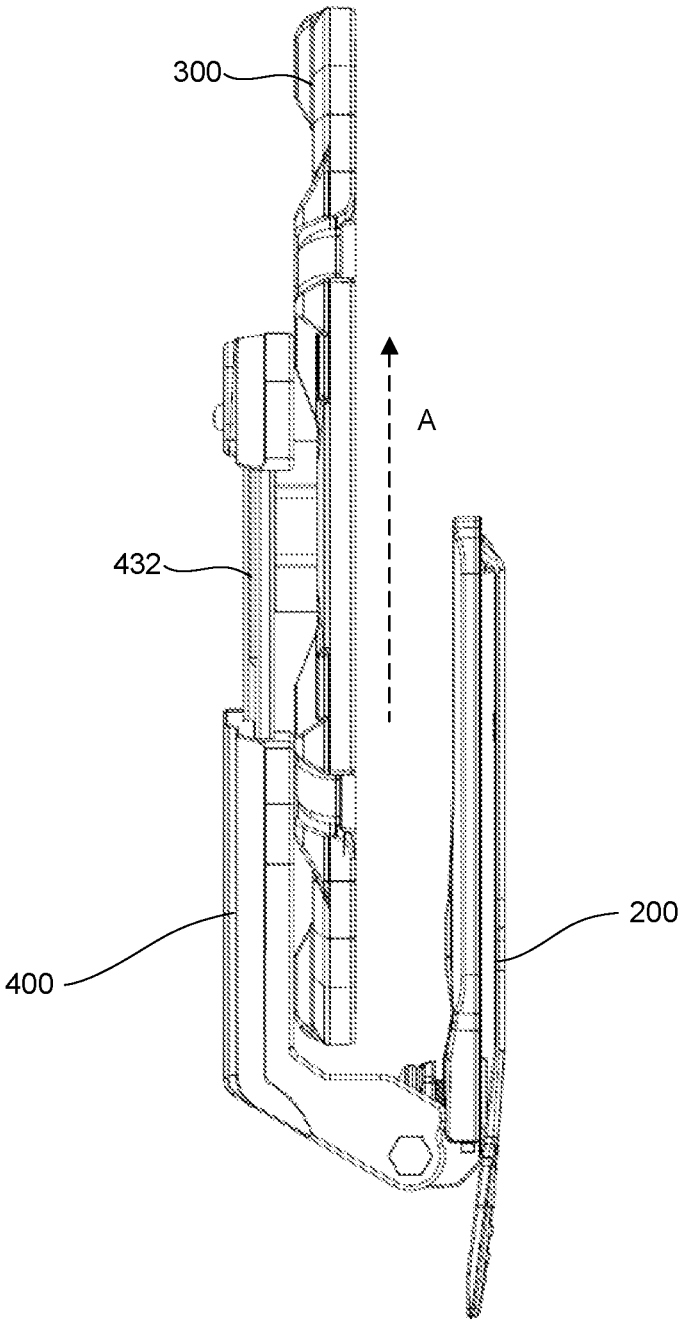

FIGS. 8A-8C variously depict another embodiment of an exemplary accessory holder including an extending arm. In this embodiment, which can include any of the features previously described above, the arm 400 includes an adjustment track 430 in which an arm extension may be telescoped outward, indicated by direction "A" in FIGS. 8A-8C. As such, a length of the arm 400 can be manually adjusted by a user. This allows, for example, a relative position of the carrier frame 300 with respect to the mounting portion 200 to be changed, and other functions described below.

Figure 9:
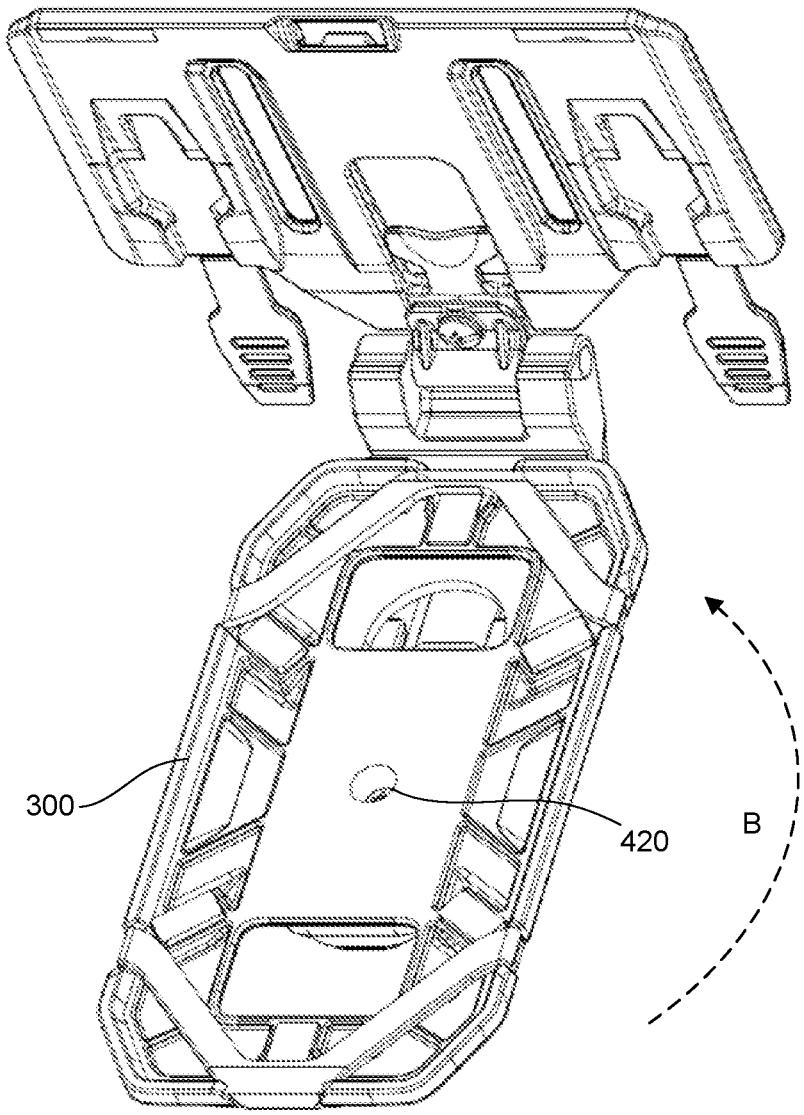
FIG. 9 depicts another embodiment of an exemplary accessory holder according to aspects of the invention including a rotating carrier frame.

FIG. 9 depicts another embodiment of an exemplary accessory holder including a rotating carrier frame. In this embodiment, which can include any of the features previously described above, the arm includes a pivot 420 that allows manual rotation of the carrier frame 300 with respect to the arm. The pivot 420 may include one or more of a cylindrical hub, a ball socket, or such other mechanisms that allow rotation in one or more directions. In the example shown in FIG. 9, the pivot 420 includes a cylindrical hub that allows rotation generally clockwise or counterclockwise in the direction labeled "B." However, the use of other types of hinges may allow additional types of rotation.

In embodiments, it may be particularly advantageous to combine the arms adjustment, as shown in FIGS. 8A-8C, with the hinge depicted in FIG. 9. By combining these features, a user can select between different viewing/operating orientations of the personal accessory, particularly those having rectangular form factors. For example, a rectangular smart phone can be stowed in the configuration shown in FIG. 2, and viewed/operated in relatively wide perspective as shown in FIG. 4. Then, with the arm 400 extended, the carrier frame 300 may be rotated to the position shown in FIGS. 8C and 9 allowing the rectangular smart phone to be viewed/operated in a relatively tall perspective.

Figure 10:
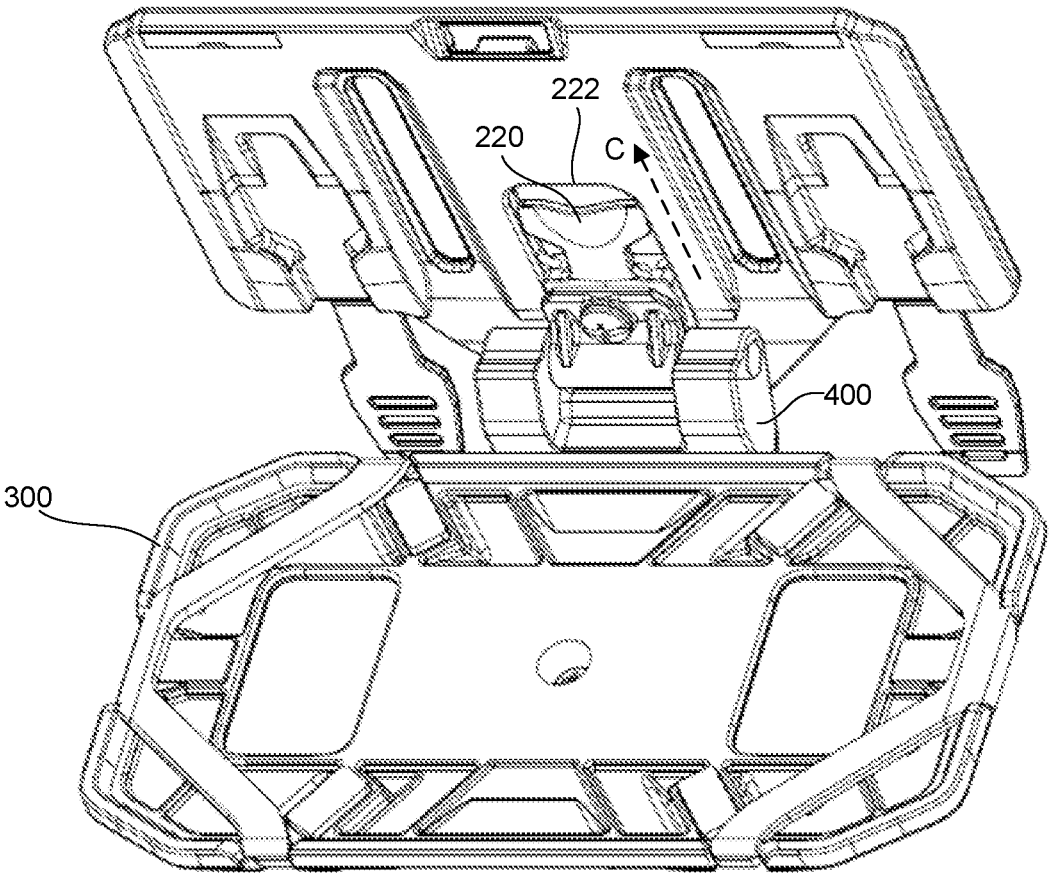
FIG. 10 depicts another embodiment of an exemplary accessory holder according to aspects of the invention including an adjustable arm.
Figure 11:
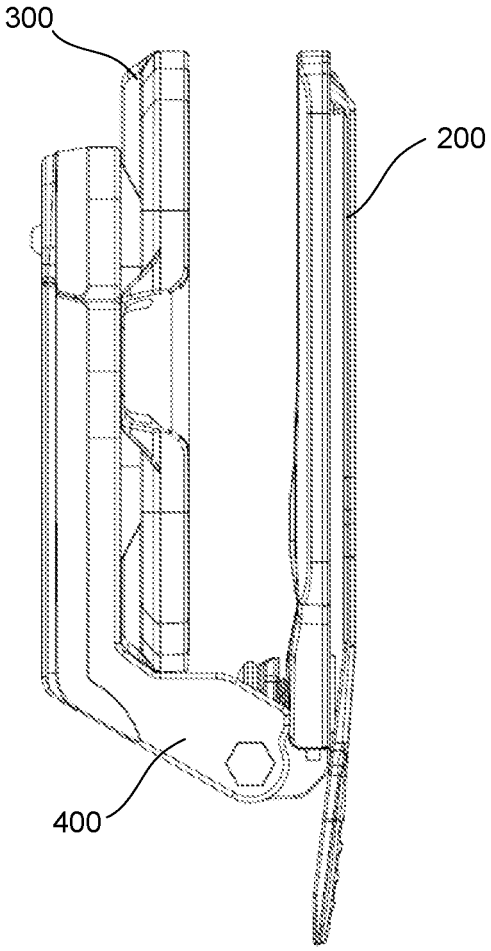
FIG. 11 is a side view of the exemplary accessory holder shown in FIG. 10, with the arm lowered with respect to the mounting portion.
Figure 12:
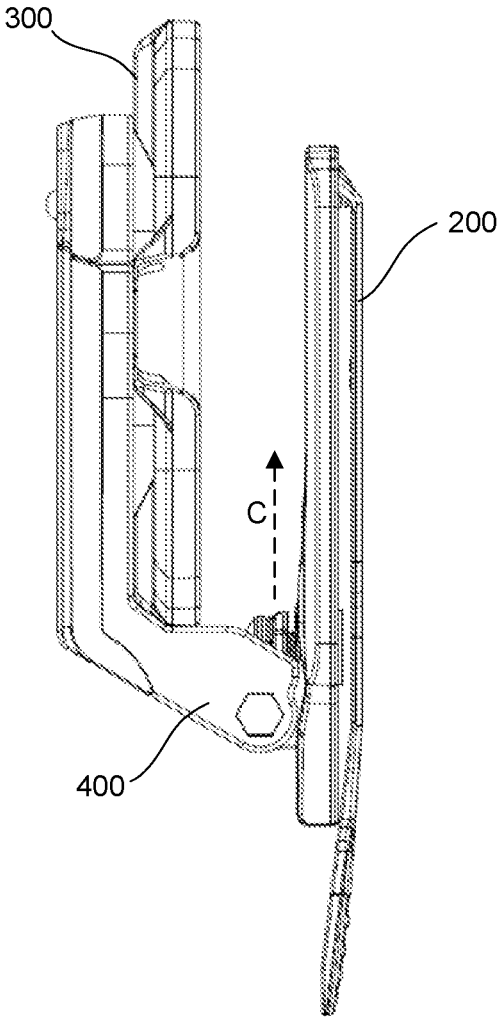
FIG. 12 is a side view of the exemplary accessory holder shown in FIG. 10, with the arm raised with respect to the mounting portion.
Figure 20:
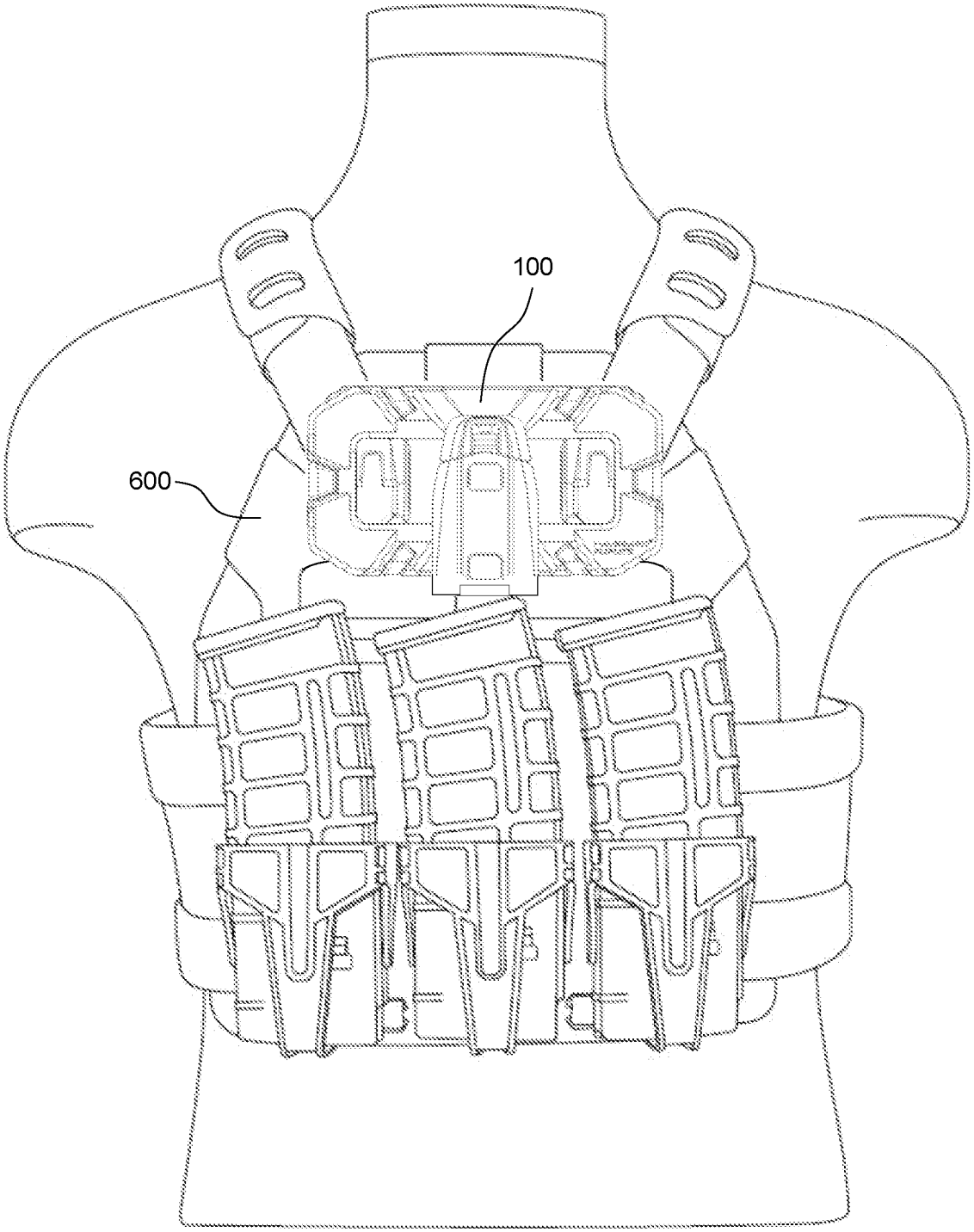
FIG. 20 depicts another embodiment of an exemplary accessory holder according to aspects of the invention attached to a plate carrier.

As shown in FIG. 10, the mounting portion 200 may also include an adjustment mechanism bounded by adjustment track 222 that allows movement of the arm 400 with respect to the mounting portion 200. For example, as shown in FIG. 10, the adjustment mechanism may be configured to allow the connector, e.g. hinge 410, for the arm 400 and the mounting portion 200 to be moved "up," labeled as direction "C" in FIGS. 10 and 12, or "down" with respect to the mounting portion 200. In this regard, FIG. 11 is a side view of the exemplary accessory holder shown in FIG. 10, with the arm 400 lowered with respect to the mounting portion 200, and FIG. 12 is a side view showing the arm 400 raised in direction "C" with respect to the mounting portion 200. Such adjustments may allow various additional benefits, such as bringing the personal accessory closer to a user's face for viewing, or moving the personal accessory up and away from other equipment on wearable support structure, such as firearm magazine holders as shown in FIG. 20.

Figure 13:
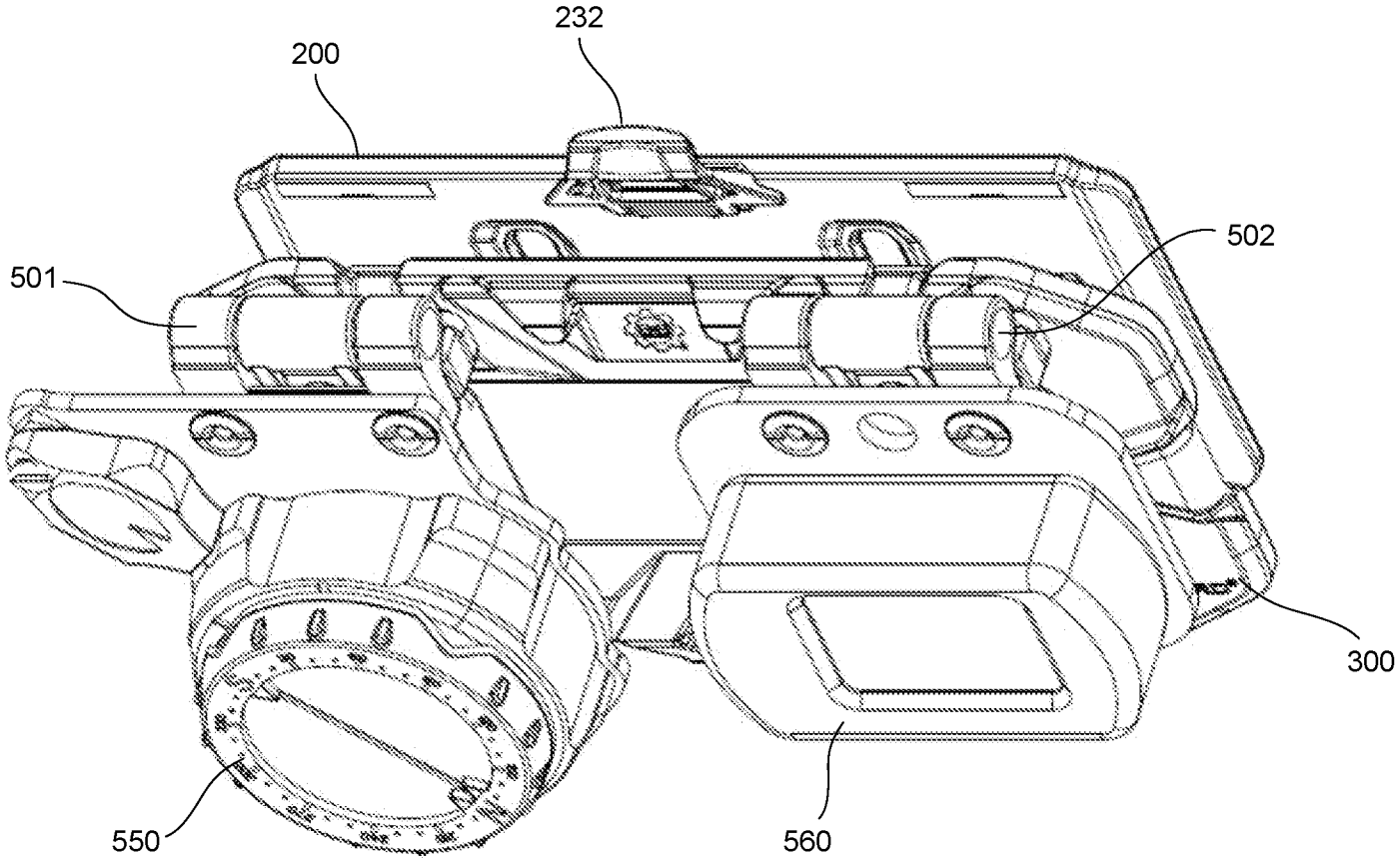
FIG. 13 depicts another embodiment of an exemplary accessory holder according to aspects of the invention including peripheral attachments connected to the carrier frame.

FIG. 13 depicts another embodiment of an exemplary accessory holder including peripheral attachments connected to the carrier frame. As shown in FIG. 13, peripheral attachments 501, 502 may be attached to carrier frame 300. Peripheral attachment 501 includes a compass 550, and peripheral attachment 502 includes a GPS 560. Other personal accessories may also be secured via peripheral attachments 501, 502. Each of the peripheral attachments 501, 502 include a hinge 510 connecting a peripheral base 520 and a peripheral arm 530. In this example, the peripheral base 520 is connected to the carrier frame and the peripheral arm 530 carries the specified accessory, such as compasses, GPS, cameras, etc.

Figure 15:
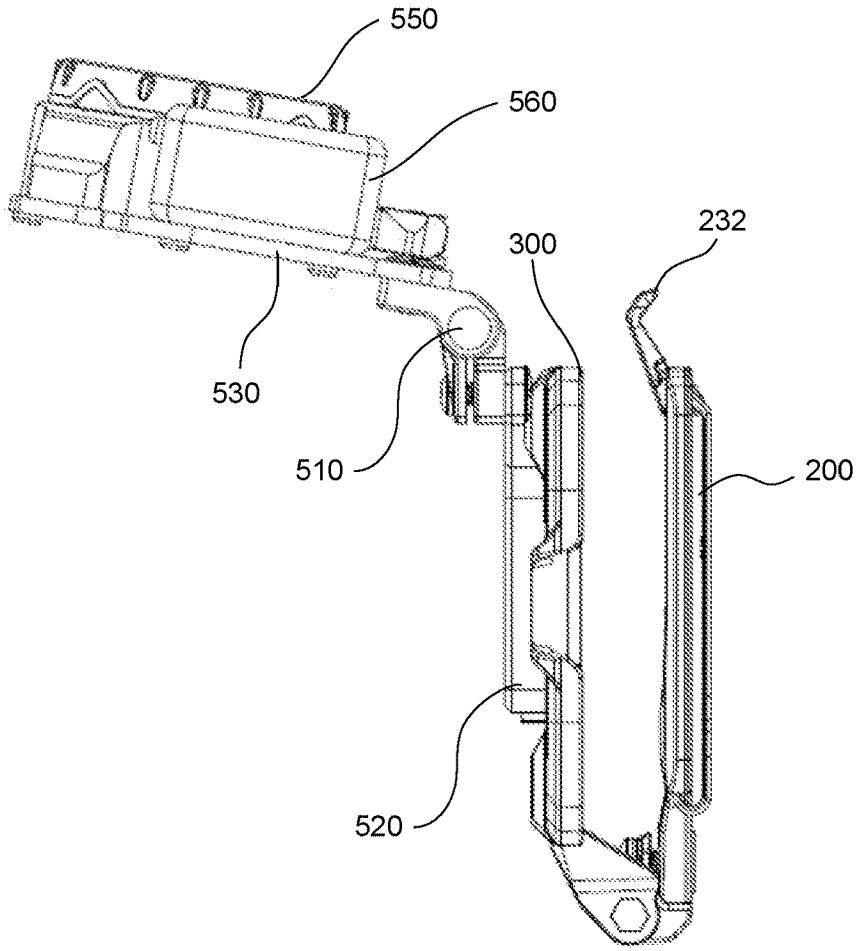
FIG. 15 is a side view of the exemplary accessory holder shown in FIG. 13, with the peripheral attachments raised/unfolded with respect to the carrier frame.
Figure 14:
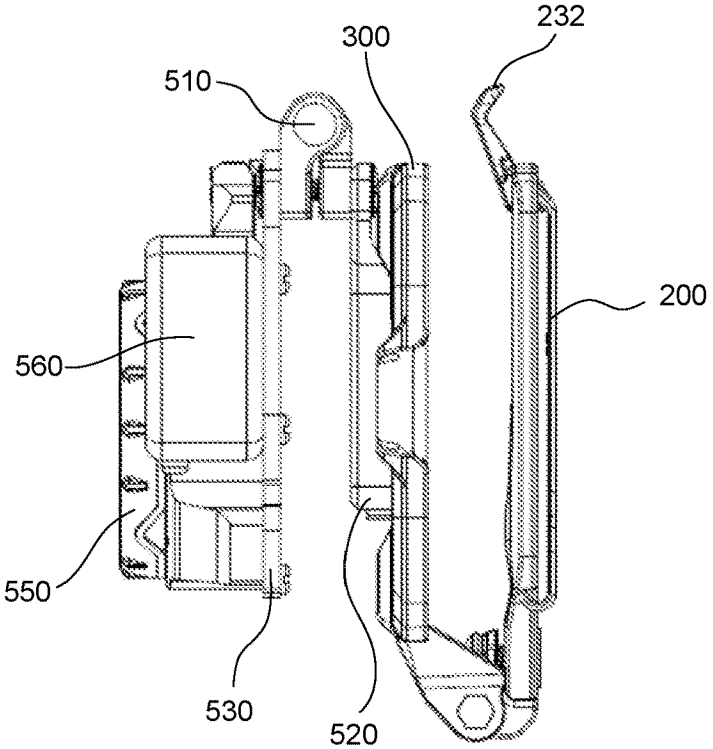
FIG. 14 is a side view of the exemplary accessory holder shown in FIG. 13, with the peripheral attachments lowered/folded with respect to the carrier frame.
Figure 16:
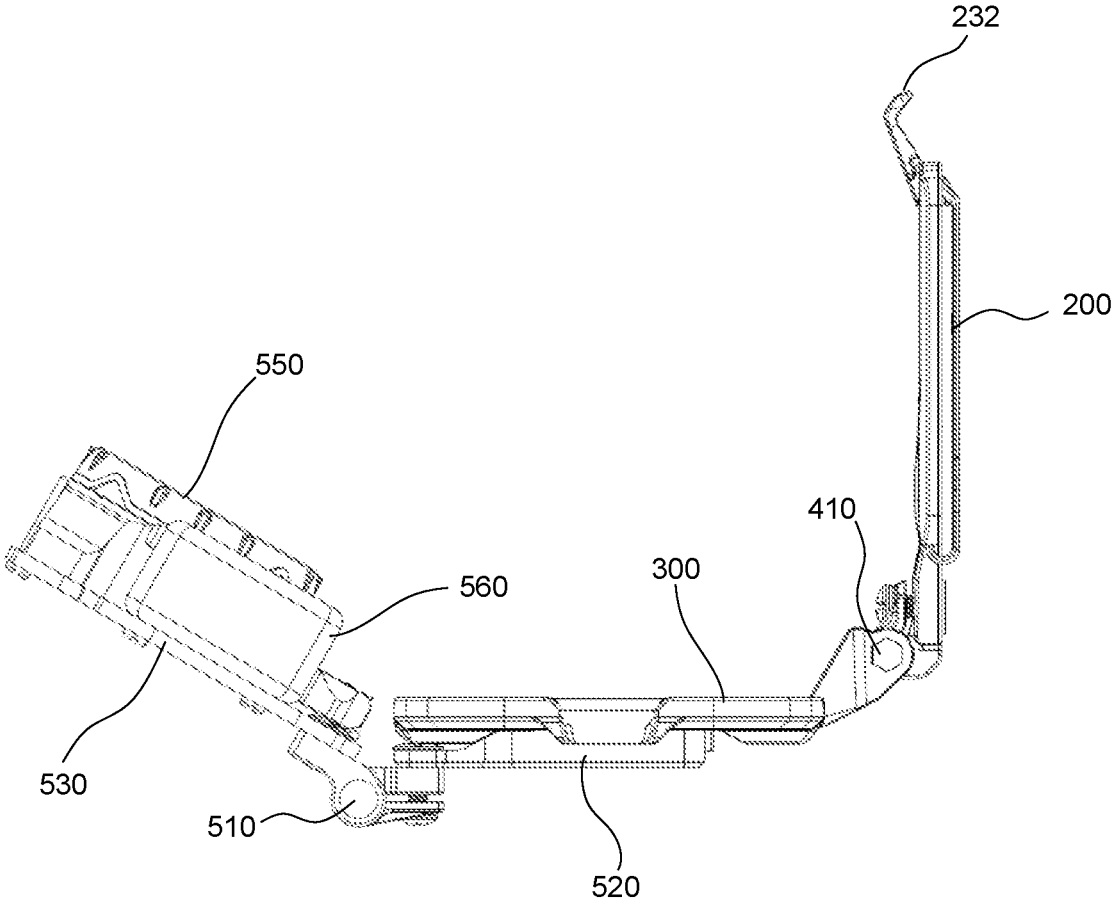
FIG. 16 is a side view of the exemplary accessory holder shown in FIG. 13, with the peripheral attachments raised/unfolded with respect to the carrier frame, and the carrier frame lowered/unfolded with respect to the mounting portion.

The hinge 510 may be configured in various ways, such as those described above, and generally allows rotation of the peripheral base 520, which is connected to the carrier frame, with respect to the peripheral arm 530. This allows the accessory holder 100 to adopt various additional configurations in which, for example, peripheral accessories may be viewed/used with the carrier frame 300 in the folded position or the unfolded position. FIG. 14 is a side view of the exemplary accessory holder shown in FIG. 13, with the peripheral attachments 501, 502 lowered/folded with respect to the carrier frame 300. FIG. 15 is a side view of the exemplary accessory holder shown in FIG. 13, with the peripheral attachments 501, 502 raised/unfolded with respect to the carrier frame 300 such that they can be viewed/used by a wearer, even with the carrier frame 300 is closed. FIG. 16 is a side view of the exemplary accessory holder shown in FIG. 13, with the peripheral attachments further raised/unfolded 501, 502 with respect to the carrier frame 300, and the carrier frame 300 lowered/unfolded with respect to the mounting portion 200, such that the peripherals and the accessory (not shown) held by the carrier frame 300 can all be viewed/used simultaneously.

Figure 17:
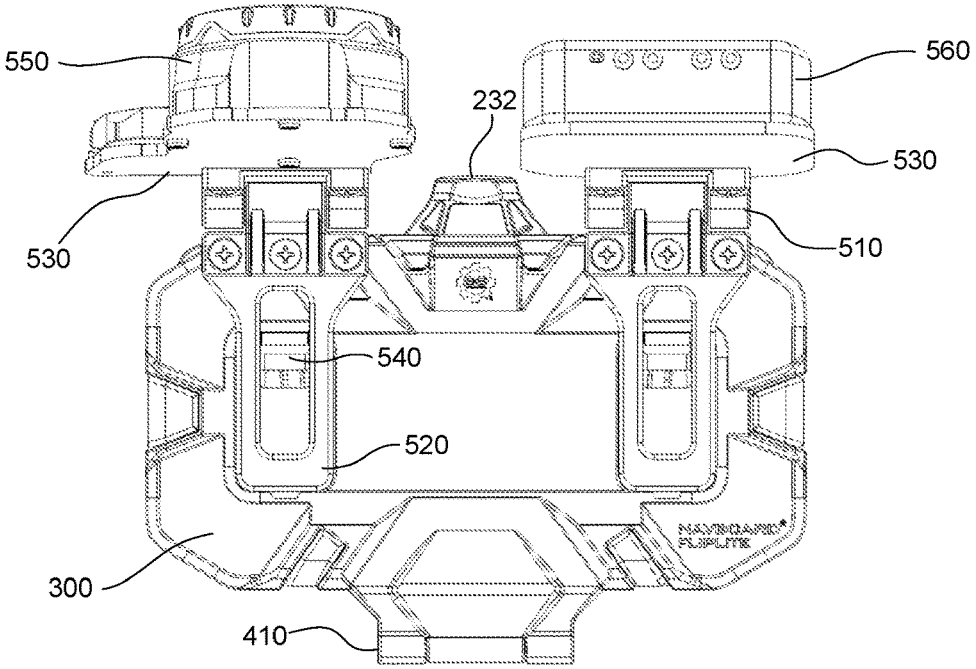
FIG. 17 is a front view of the exemplary accessory holder shown in FIG. 13, showing additional details of the peripheral attachment mechanism.
Figure 18:
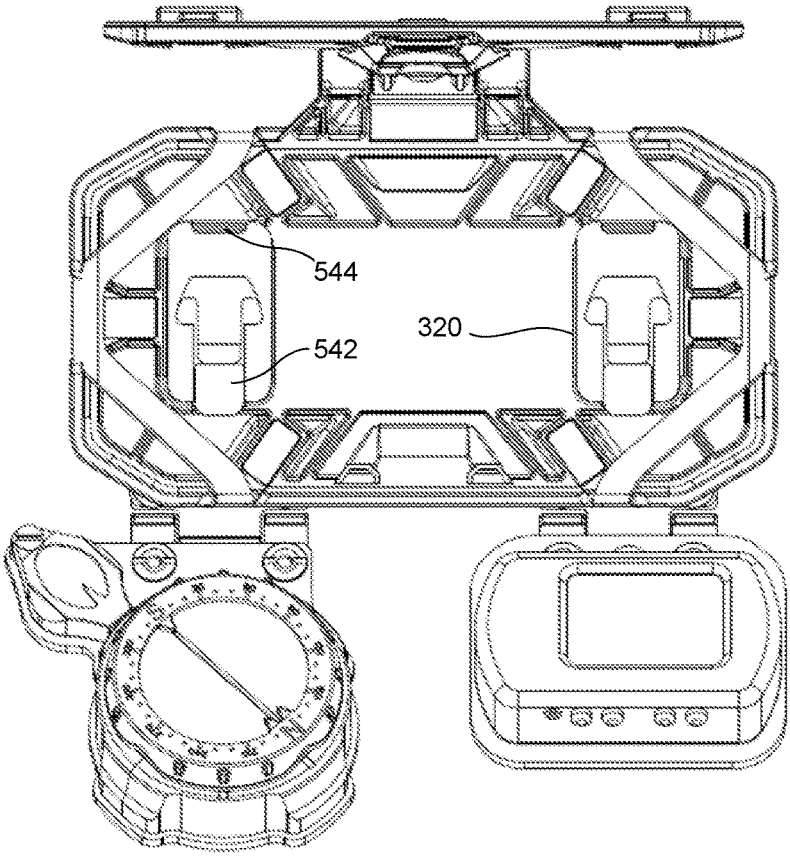
FIG. 18 is a top-down view of the exemplary accessory holder shown in FIG. 13, showing additional details of the peripheral attachment mechanism.

The carrier frame 300 may include peripheral attachment voids 320, such as those shown in FIG. 4. As shown in FIGS. 17 and 18, the peripheral attachments 501, 502 may be mounted to the peripheral attachment voids 320 via, for example, peripheral attachment and adjustment mechanisms 540. Such mechanisms may include a spring tab 542 and a fixed tab 544 that allow the peripheral attachments to be easily secured to, and removed from, the peripheral attachment voids 320, e.g. by a user pinching the spring tab 542 to insert or remove the peripheral attachments. This can be readily done without doffing the wearable support structure that the accessory holder may be attached to.

Figure 19:
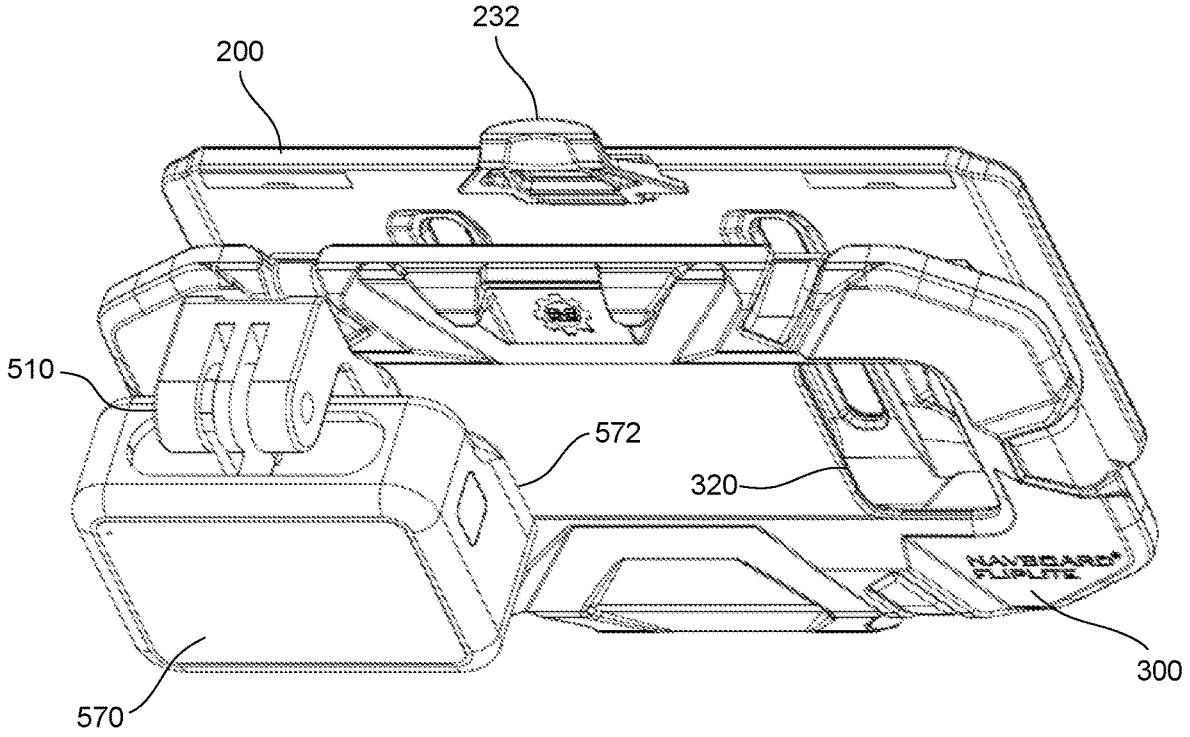
FIG. 19 depicts another embodiment of an exemplary accessory holder according to aspects of the invention including a camera peripheral attachment connected to the carrier frame.

By way of further example, FIG. 19 depicts another embodiment of an exemplary accessory holder including a camera 570 as a peripheral attachment connected to the carrier frame. As shown in FIG. 19, it may be preferable to mount peripheral accessories in a manner that allows, lenses, screens, or other parts, to be protected with the peripheral attachment in a folded configuration. In this example, a lens 572 of camera 570 is facing carrier frame 300 to protect it when not in use.

FIG. 20 depicts another embodiment of an exemplary accessory holder attached to wearable support structure, in this case a personal armor plate carrier. As discussed herein, the accessory holder 100 may be secured to the plate carrier 600 by routing the mounting straps 210 through built-in attachment features, e.g. MOLLE webbing receptacles, of the plate carrier and secured back to the mounting tab wells 214.

The attachment means, members, and methods described above are merely examples and are not limiting of attachment means, methods, and members of the accessory holder 100 to any structure, surface or object. Rather, any attachment means, method, or member of attaching a accessory holder 100 to an object, surface, material, or piece of equipment is within the scope of embodiments.

While various embodiments have been described above, it is to be understood that the examples and embodiments described above are for illustrative purposes only and that various modifications or changes in light thereof will be suggested to persons skilled in the art, and are to be included within the spirit and purview of this application and scope of the appended claims. Therefore, the above description should not be understood as limiting the scope of the invention as defined by the claims.

What is claimed is:

1. An accessory holder, comprising:

a mounting portion configured to attach the accessory holder to wearable support structure, the mounting portion including attachment means for securing the accessory holder to the wearable support structure;

a carrier frame configured to hold a first personal accessory, the carrier frame including a retaining means for holding the first personal accessory; and an arm connecting the carrier frame to the mounting portion, the arm including a first hinge configured to allow the carrier frame to move between a folded position and an unfolded position with respect to the mounting portion, wherein the mounting portion includes a retaining tab, and the carrier frame includes a retaining tab well, the retaining tab well sized and shaped to accommodate and hold the retaining tab with the carrier frame in the folded position such that the carrier frame is prevented from unfolding from the mounting portion.

2. The accessory holder of claim 1, wherein the mounting portion includes an adjustment track configured to allow movement of the arm with respect to the mounting portion.

3. The accessory holder of claim 1, wherein a length of the arm is configured to be manually adjusted by a user, such that a relative position of the carrier frame with respect to the mounting portion may be changed.

4. The accessory holder of claim 1, wherein the arm includes a pivot configured to allow manual rotation of the carrier frame with respect to the arm.

5. The accessory holder of claim 1, wherein the carrier frame is configured to hold a smart phone having a screen, and the accessor holder is configured to allow viewing of the screen in the unfolded position, and to protect the screen from direct contact in the folded position.

6. The accessory holder of claim 1, wherein the first personal accessory is at least one of a compass, a GPS, or a camera.

7. The accessory holder of claim 1, wherein the wearable support structure is at least one of a plate carrier, a tactical vest, a backpack, a parachute harness, or a personal harness.

8. The accessory holder of claim 1, wherein the attachment means include MOLLE compliant straps.

9. The accessory holder of claim 1, wherein the retaining means includes a length of elastomeric material configured to hold the first personal accessory to the carrier frame.

10. The accessory holder of claim 9, wherein the length of elastomeric material spans corners of the carrier frame, such that personal accessories having different lengths or widths may be secured within a perimeter of the carrier frame.

11. The accessory holder of claim 9, wherein the length of elastomeric material includes a thin portion and a thick portion, the thick portion having a thickness that is greater than that of the thin portion, and wherein the thick portion configured to at least one of provide a raised friction surface that helps secure the first personal accessory in the carrier frame, or provide a plug that secures the length of elastomeric material to a plug well formed in the carrier frame.

12. The accessory holder of claim 1, wherein the carrier frame includes a peripheral attachment void, the accessory holder further comprising a peripheral attachment that is mounted to the peripheral attachment void, and the peripheral attachment configured to hold a second personal accessory.

13. The accessory holder of claim 12, wherein the peripheral attachment includes a peripheral base having a peripheral attachment mechanism configured to join with the peripheral attachment void, a peripheral arm configured to hold the second personal accessory, and a second hinge connecting the peripheral base and the peripheral arm.

14. The accessory holder of claim 12, wherein the carrier frame includes a plurality of peripheral attachment voids, the accessory holder comprises a separate peripheral attachment mounted to each of the peripheral attachment voids, and each of the peripheral attachments is configured to hold a separate second personal accessory.

15. An accessory holder, comprising:

a mounting portion configured to attach the accessory holder to wearable support structure, the mounting portion including attachment straps for securing the accessory holder to the wearable support structure;

a carrier frame configured to hold a personal accessory, the carrier frame including a retaining strap made of an elastomeric material, the retaining strap configured to hold the personal accessory to the carrier frame; and an arm connecting the carrier frame to the mounting portion, the arm including a hinge configured to allow the carrier frame to move between a folded position and an unfolded position with respect to the mounting portion, wherein the mounting portion includes an adjustment track configured to allow movement of the arm with respect to the mounting portion.

16. The accessory holder of claim 15, wherein the carrier frame is configured to hold a smart phone having a screen, and the elastomeric material spans corners of the carrier frame, such that smart phones having different lengths, widths or thicknesses may be secured within a perimeter of the carrier frame.

17. The accessory holder of claim 15, wherein the retaining strap includes a thin portion and a thick portion, the thick portion having a thickness that is greater than that of the thin portion, and wherein the thick portion configured to at least one of provide a raised friction surface that helps secure the first personal accessory in the carrier frame, or provide a plug that secures the retaining strap to a plug well formed in the carrier frame.

18. An accessory holder, comprising:

a mounting portion configured to attach the accessory holder to wearable support structure, the mounting portion including a mounting strap for securing the accessory holder to the wearable support structure;

a carrier frame configured to hold a personal accessory, the carrier frame including a retaining means for holding the personal accessory; and an arm connecting the carrier frame to the mounting portion, the arm including a hinge configured to allow the carrier frame to move between a folded position and an unfolded position with respect to the mounting portion, wherein the mounting strap includes an attachment tab at a distal end of the mounting strap, and wherein the mounting portion further includes a rigid base element, the rigid base element including an attachment well, the attachment well sized and shaped to accommodate and hold the attachment tab.

19. The accessory holder of claim 18, wherein the mounting portion includes a rigid base and a retaining tab attached to the rigid base via a length of elastic material, wherein the carrier frame includes a retaining tab well, the retaining tab well sized and shaped to accommodate and hold the retaining tab with the carrier frame in the folded position, and wherein a user can release the retaining tab from the retaining tab well by pulling the retaining tab and thereby stretching the length of elastic material.

20. The accessory holder of claim 18, wherein the mounting portion includes an adjustment track configured to allow movement of the arm with respect to the mounting portion.

* * * * *